US006701949B2

(12) United States Patent
Carter

(10) Patent No.: US 6,701,949 B2
(45) **Date of Patent: *Mar. 9, 2004**

(54) ERECTABLE CANOPY WITH REINFORCED ROOF STRUCTURE

(76) Inventor: Mark C. Carter, 1601 Iowa Ave., Riverside, CA (US) 92507

( * ) Notice: Subject to any disclaimer, the term of this patent is extended or adjusted under 35 U.S.C. 154(b) by 0 days.

This patent is subject to a terminal disclaimer.

(21) Appl. No.: 10/337,945

(22) Filed: Jan. 6, 2003

(65) Prior Publication Data

US 2003/0131876 A1 Jul. 17, 2003

Related U.S. Application Data

(63) Continuation of application No. 10/052,292, filed on Jan. 18, 2002, now Pat. No. 6,502,597, which is a division of application No. 09/490,860, filed on Jan. 24, 2000, now Pat. No. 6,382,224, which is a continuation-in-part of application No. 09/131,148, filed on Aug. 7, 1998, now Pat. No. 6,041,800, and a continuation-in-part of application No. 09/277,250, filed on Mar. 26, 1999, now Pat. No. 6,076,312, which is a continuation of application No. 09/025,897, filed on Feb. 18, 1998, now Pat. No. 5,921,260, and a continuation of application No. 08/823,616, filed on Mar. 25, 1997, now Pat. No. 5,797,412, and a continuation of application No. 08/604,801, filed on Feb. 23, 1996, now Pat. No. 5,632,293, and a continuation of application No. 08/279,476, filed on Jul. 25, 1994, now Pat. No. 5,511,572.

(51) Int. Cl.[7] ..... E04H 15/50

(52) U.S. Cl. ..... 135/145; 135/131; 135/151; 135/158; 52/109; 52/641

(58) Field of Search ..... 135/145, 131, 135/143, 144, 147, 158, 139, 151; 52/109, 641, 646; 211/197

(56) References Cited

U.S. PATENT DOCUMENTS

| | | | | |
|---|---|---|---|---|
| 1,712,836 A | | 5/1929 | Mills | |
| 1,853,367 A | | 4/1932 | Mace | |
| 2,771,896 A | * | 11/1956 | Call | 135/140 |
| 4,407,317 A | | 10/1983 | Crandall | |
| 4,601,301 A | | 7/1986 | Hermanson | |
| 4,607,656 A | | 8/1986 | Carter | |
| 4,641,676 A | | 2/1987 | Lynch | |
| 4,779,635 A | * | 10/1988 | Lynch | 135/145 X |

(List continued on next page.)

FOREIGN PATENT DOCUMENTS

| | | | | |
|---|---|---|---|---|
| AU | 000025649 | | 6/1992 | |
| AU | B-25649/88 | | 6/1992 | |
| GB | 002258475 | | 10/1993 | |
| GB | 002320509 | | 6/1998 | |
| WO | WO 89/07696 | * | 8/1989 | 135/144 |
| WO | 0013284 | | 8/1993 | |

OTHER PUBLICATIONS

Copy of the International Search Report Relating to PCT/US00/41992 Dated Jun. 27, 2001.

*Primary Examiner*—Winnie S. Yip
(74) *Attorney, Agent, or Firm*—Fulwider Patton Lee & Utecht, LLP

(57) ABSTRACT

The lightweight erectable canopy shelters include a plurality of legs connected together by an extendible perimeter assembly of link members. In one embodiment, the roof structure is formed by a pole members pivotally mounted to the upper ends of the legs so as to extend across the shelter, and movable between a lowered position and a raised, upwardly arching position. The pole members are pivotally coupled to a central hub, and each of the pole members comprises pole sections hinged to permit downward folding and upward unfolding until they are fully extended. Corner support strut members are pivotally mounted to the legs, to be rotatable upwardly to engage and support the pole members. In an alternate embodiment, opposing sides of the shelter are connected together by a central assembly of link members, and at least one of the sides of the shelter is raised, being formed by a pair of first and second link members dimensioned so as to extend above the upper ends of the legs when the shelter is in an extended configuration.

3 Claims, 7 Drawing Sheets

U.S. PATENT DOCUMENTS 4,885,891 A * 12/1989 Lynch ..... 52/646
4,947,884 A 8/1990 Lynch
5,022,420 A * 6/1991 Brim ..... 135/88.04
5,035,253 A 7/1991 Bortles
5,244,001 A 9/1993 Lynch
5,274,980 A 1/1994 Zeigler
5,275,188 A 1/1994 Tsai
5,421,356 A 6/1995 Lynch
5,490,533 A 2/1996 Carter
5,634,483 A 6/1997 Gwin
5,638,853 A 6/1997 Tsai
5,701,923 A 12/1997 Losi, Jr. et al.
5,794,640 A 8/1998 Jang
5,934,301 A 8/1999 Carter
5,944,040 A 8/1999 Jang
6,148,835 A * 11/2000 Rhee ..... 135/145
6,206,020 B1 * 3/2001 Lynch ..... 135/128

* cited by examiner

FIG. 8
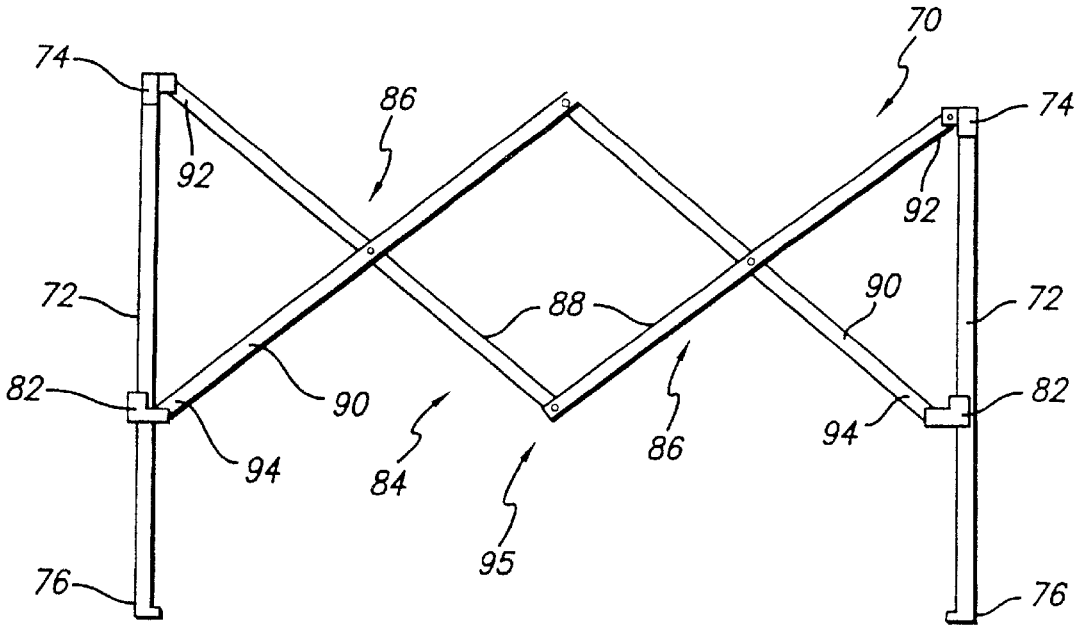
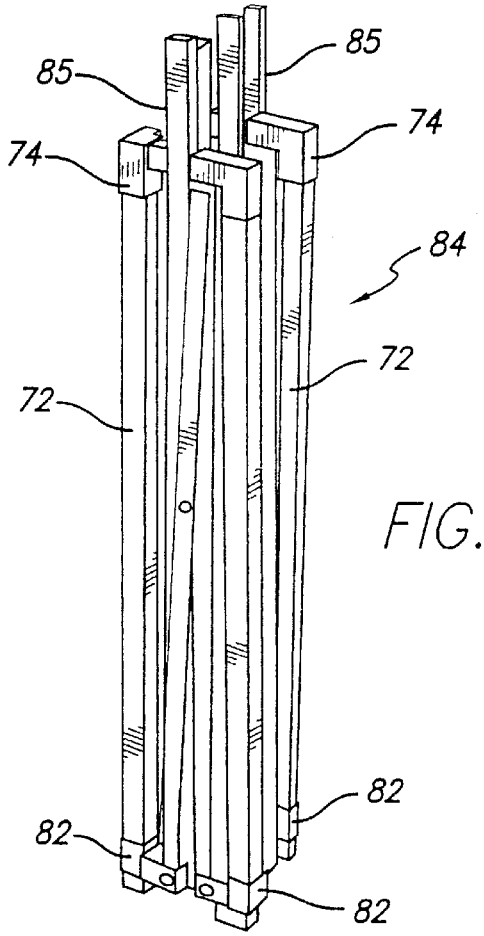
FIG. 7

ERECTABLE CANOPY WITH REINFORCED ROOF STRUCTURE

RELATED APPLICATIONS

This is a continuation of Ser. No. 10/052,292 filed Jan. 18, 2002, now U.S. Pat. No. 6,502,597, which is a Divisional of Ser. No. 09/490,860 filed Jan. 24, 2000, now U.S. Pat. No. 6,382,224, which is a continuation in part of Ser. No. 09/131,148 filed Aug. 7, 1998, now U.S. Pat. 6,041,800, and a continuation in part of Ser. No. 09/277,250 filed Mar. 26, 1999, now U.S. Pat. No. 6,076,312, which is a continuation of Ser. No. 09/025,897 filed Feb. 18, 1998, now U.S. Pat. No. 5,921,260, continuation of Ser. No. 08/823,616 filed Mar. 25, 1997, now U.S. Pat. No. 5,797,412, continuation of Ser. No. 08/604,801 filed Feb. 23, 1996, now U.S. Pat. No. 5,632,293, continuation of Ser. No. 08/279,476 filed Jul. 25, 1994, now U.S. Pat. No. 5,511,572.

FIELD OF THE INVENTION

This invention relates generally to folding, collapsible structures, and more particularly relates to a collapsible, field shelter structure having an elevated canopy.

DESCRIPTION OF RELATED ART

Temporary shelters that can be easily transported and rapidly set up at emergency sites can be particularly useful in providing temporary care and housing. Such shelters can also be useful for non-emergency outdoor gatherings, such as for temporary military posts, field trips, and the like. One known quickly erectable, collapsible shelter includes a framework of X-shaped linkages, telescoping legs, and a canopy covering the framework. The legs of that shelter are capable of telescoping to about twice their stowed length, and the framework of X-shaped truss pairs is capable of horizontal extension between the legs to support a canopy. The framework can be constructed of lightweight material, and the telescoping legs can be extended to raise the framework of the shelter.

In order to increase the portability and versatility of such temporary shelters, it is important that they be not only lightweight and small enough in a folded, compact configuration so that can be readily transported and carried, but also large enough and with sufficient headroom when unfolded for a group of people to stand underneath them. As such structures have become larger and more lightweight, reinforcing features that contribute to strength, roominess, and ease of use in setting up and taking down such structures have also become increasingly important.

One modern type of tent structure provides a lightweight roof structure with four roof rods joined together at the center by a head connector member, with each of the roof rods formed of two rod members interconnected by intermediate pivot connecting members. The roof rods are supported on top of a base structure formed by four legs and scissors-type linkages connected to a top fixed connector and a lower sliding connector of each leg. Each intermediate pivot connecting member between the individual rod members of the roof rods confines upward rotation of the rod members to an upmost, upwardly arching position, but allows the roof rods to be folded downwardly when the tent is collapsed. Reinforcing linking rods provided at the corners of the roof structure are coupled at one end to the lower sliding connectors on the legs, and are slidingly coupled at the other end to the roof rods, to assist in stabilizing the roof rods in the upwardly arched position when the shelter is fully unfolded and extended. However, the sliding coupling of the corner linking rods must slide over a considerable length of the roof rods which can lead to abrasion and wear of the roof rods and eventually interfere with the sliding of the linking rods during setting up and taking down of the structure, without providing any significant reinforcing strength or vertical support of the roof structure when the shelter is fully unfolded and extended.

Lightweight shelters with raised roof structures are particularly useful for holding gatherings in inclement weather, to provide needed headroom and shed precipitation and debris, but raised roof structures can be particularly vulnerable to downward forces placed on a roof structure by strong winds. One approach to providing a lightweight shelter with a raised roof structure has been to make the roof structure flexible so that it can move between a raised, upwardly arching configuration when weather permits, and a lowered, downwardly arching configuration if the downward force of the wind is sufficiently strong, to automatically present a reduced profile to strong winds when necessary. However, there remains a need for an improved, reinforced raised roof structure for such lightweight canopy shelters that will permit the raised roof structure to withstand greater wind pressures, to be able to provide a desired headroom and shed precipitation and debris under a wider variety of weather situations. The present invention meets these and other needs.

SUMMARY OF THE INVENTION

Briefly, and in general terms, the present invention provides for an improved, lightweight erectable canopy shelter with a reinforced raised roof structure that is strengthened and stabilized to permit the roof structure to remain in a raised configuration in order to provide adequate headroom and adequately shed debris and precipitation, and to resist downward wind pressures on the roof structure.

The present invention accordingly provides, in one preferred embodiment, for an improved, lightweight and quickly erectable canopy shelter with a reinforced roof structure. The roof structure of the shelter is supported by a plurality of legs having upper and lower ends connected together by an extendible perimeter assembly of link members. In one currently preferred approach, the perimeter assembly of link members comprises pairs of link members being pivotally connected together in a scissors linkage configuration so as to be extendable from a first collapsed position extending horizontally between adjacent pairs of legs to a second extended position extending horizontally between the adjacent pairs of legs. A slider member is slidably mounted to each of the legs, and in a presently preferred aspect, the legs of the shelter comprise telescoping upper and lower sections, with the slider members mounted to upper sections of the legs. The pairs of link members of the extendible perimeter assembly preferably comprise first and second link members, with the first link member having an outer end pivotally connected to the upper end of a leg, and the second link member having an outer end pivotally connected to a slider member of a leg, and with the pairs of link members connected together at their inner ends.

In this embodiment of the invention, the roof structure of the shelter is preferably provided by a canopy assembly comprised of a plurality of pole members having their outer ends pivotally mounted to the upper ends of the legs so as to extend across the shelter, and to be movable between a lowered position when the shelter is in its folded and unextended configuration, and a raised, upwardly arching position when the shelter is unfolded and extended, in which position a canopy cover may be placed over the roof structure of the canopy shelter. In a presently preferred aspect of the invention, the pole members are pivotally coupled at their inner ends to a central hub connector, and each of the pole members comprises a plurality of pole sections hingedly coupled together permitting inward, downward folding of the pole members to a folded configuration, and limiting upward unfolding of the pole members to a fully extended configuration.

In this embodiment of the invention, corner support strut members are also advantageously provided for reinforcing and stabilizing the pole members of the canopy assembly when the shelter is unfolded and extended. The outer ends of the support strut members are pivotally mounted to the legs, and in a presently preferred embodiment, each support strut member is pivotally mounted a slider member of a leg. Thus, when the canopy assembly is unfolded and extended, the corner support struts can be rotated upwardly to engage and support the pole members, and in a preferred aspect, the inner ends of the strut members each have a support bracket adapted to be positioned against and receive an adjacent pole member to support the pole member in the raised, upwardly extending position. The pole members may also have a tab extending from the surface of the pole members so as to provide a brace against which the support brackets may be lodged to allow the support strut members to positively lock the pole members in an upwardly arched configuration until the support struts are rotated downwardly to release the pole members to be foldable downward.

In a preferred alternate embodiment of the improved, lightweight and quickly erectable canopy shelter with a reinforced roof structure, the present invention provides for a quickly erectable canopy shelter having a plurality of legs with an extendible perimeter assembly of link members connecting the legs together and forming a plurality of sides of the shelter, and opposing sides connected together by a central assembly of link members. As in the first embodiment, the perimeter assembly of link members preferably comprises pairs of link members pivotally connected together in a scissors linkage configuration so as to be extendable from a first collapsed position extending horizontally between adjacent pairs of legs to a second extended position extending horizontally between the adjacent pairs of legs, in which position a canopy cover may be placed over the roof structure of the canopy shelter. A slider member is slidably mounted to each of the legs, and in a presently preferred aspect, the legs of the shelter comprise telescoping upper and lower sections, with the slider members mounted to upper sections of the legs. The pairs of link members of the extendible perimeter assembly preferably comprise first and second link members, with the first link member having an outer end pivotally connected to the upper end of a leg, and the second link member having an outer end pivotally connected to a slider member of a leg, and with the pairs of link members connected together at their inner ends.

In a currently preferred aspect of this embodiment, at least one of the sides is raised, being formed by a pair of first and second link members dimensioned so as to extend above the upper ends of the legs when the shelter is in an extended configuration. In a presently preferred aspect, the inner ends of the first link members are connected together and the inner ends of the second link members are connected together, and the second link members are longer than the first link members on each raised side so as to cause the second link members of the side to extend above the upper ends of the legs when the shelter is in an extended configuration. In a currently preferred embodiment, two opposing sides of the shelter are raised so as to form a gabled configuration of the shelter when the shelter is extended.

In this embodiment, opposing sides are also advantageously connected together by a central assembly of link members extending across the shelter so as to reinforce the roof structure. In a currently preferred embodiment, the central assembly of link members is comprised of central pairs of link members pivotally connected together, with each pair of link members including a first link member and a second link member, and the first and second link members having their outer ends pivotally connected to the opposing sides of the extendible perimeter assembly of link members, the first and second link members of the central pairs of link members being pivotally connected together in a scissors configuration so as to be extendable horizontally from a first collapsed position to a second extended position. In one presently preferred implementation of the invention, in each pair of link members the outer end of the first link member is connected to the inner end of the second link member of the perimeter pair of link members on one of the opposing sides, and the outer end of the second link member is connected to the inner end of the first link member of the perimeter pair of link members.

These and other aspects and advantages of the invention will become apparent from the following detailed description and the accompanying drawings, which illustrate by way of example the features of the invention.

BRIEF DESCRIPTION OF THE DRAWINGS

FIG. 7 is a perspective view of a second embodiment of a quickly erectable canopy shelter according to the invention in a folded configuration;

FIG. 8 is a side elevational view of the quickly erectable canopy shelter of FIG. 7 in a fully extended configuration;

DETAILED DESCRIPTION OF THE PREFERRED EMBODIMENTS

As attempts have been made to improve portability and expansion of quickly erectable temporary shelter structures, maximizing extended dimension and minimizing weight, modification of roof structures of such shelters to provide adequate headroom, shed precipitation and debris, and to withstand strong winds under a variety of conditions has become increasingly important.

Figure 3:
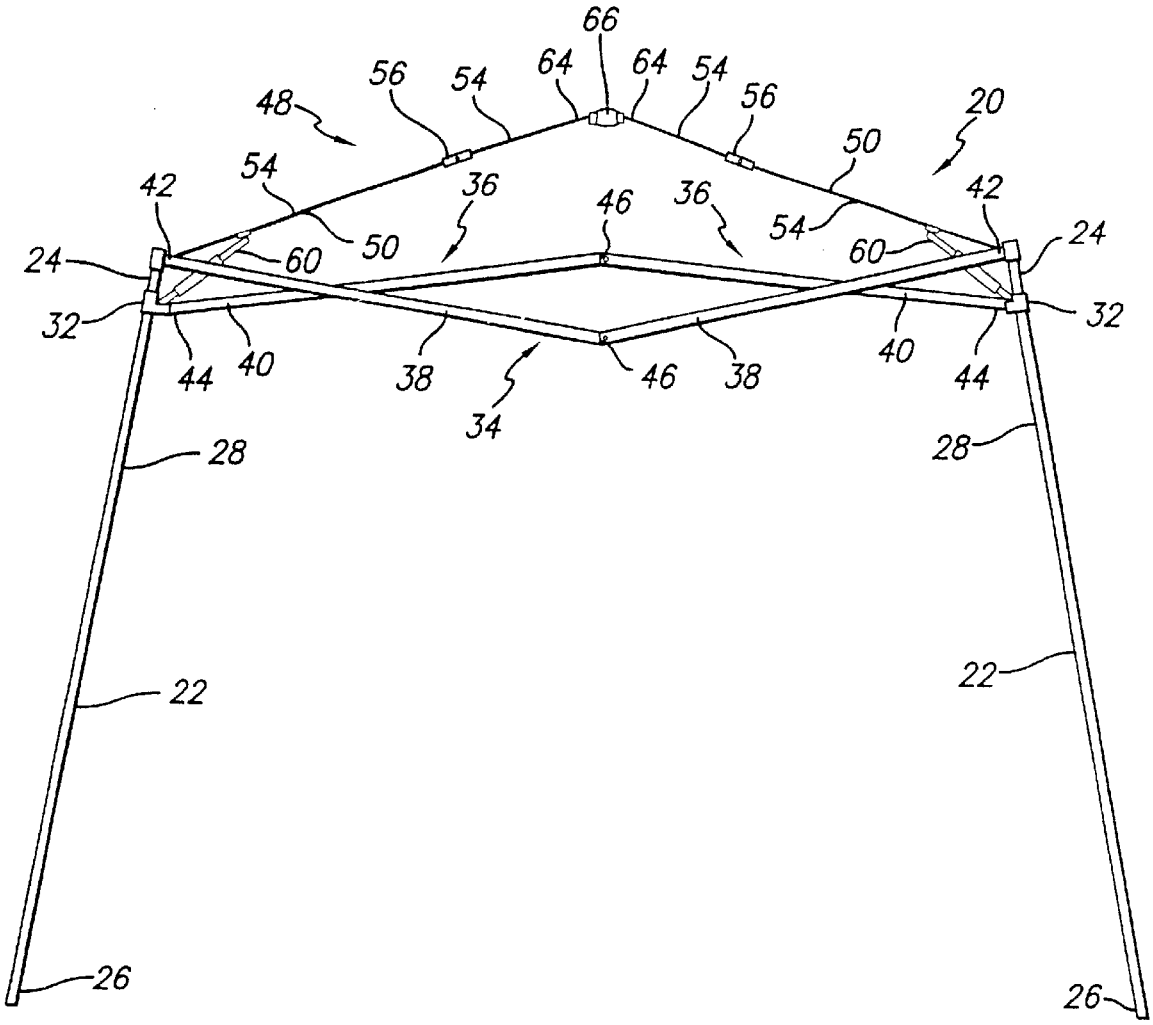
FIG. 3 is a side elevational view of the quickly erectable canopy shelter of FIG. 1.
Figure 4:
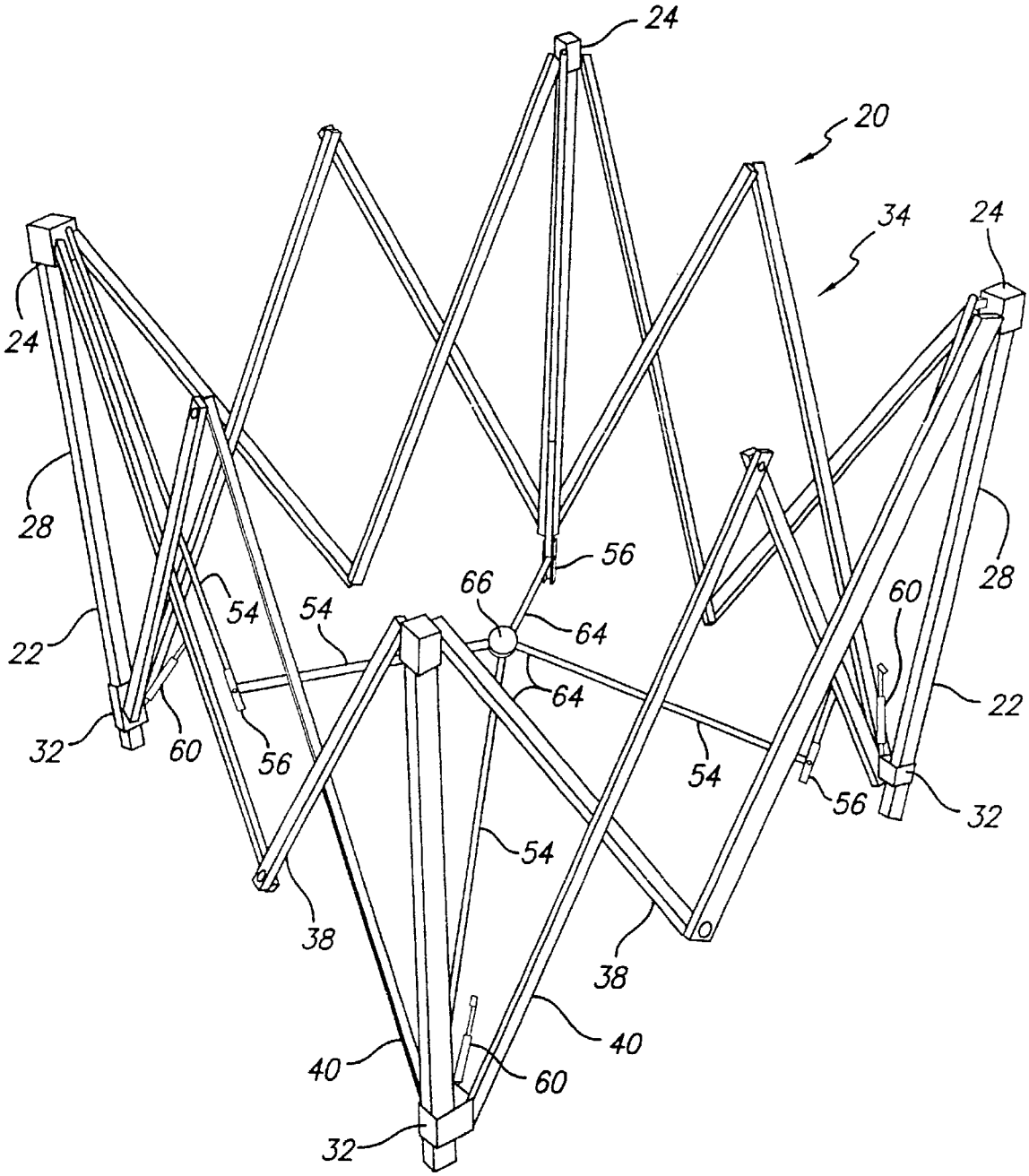
FIG. 4 is a top perspective view of the quickly erectable canopy shelter of FIG. 1 in a partially unfolded configuration.
Figure 5:
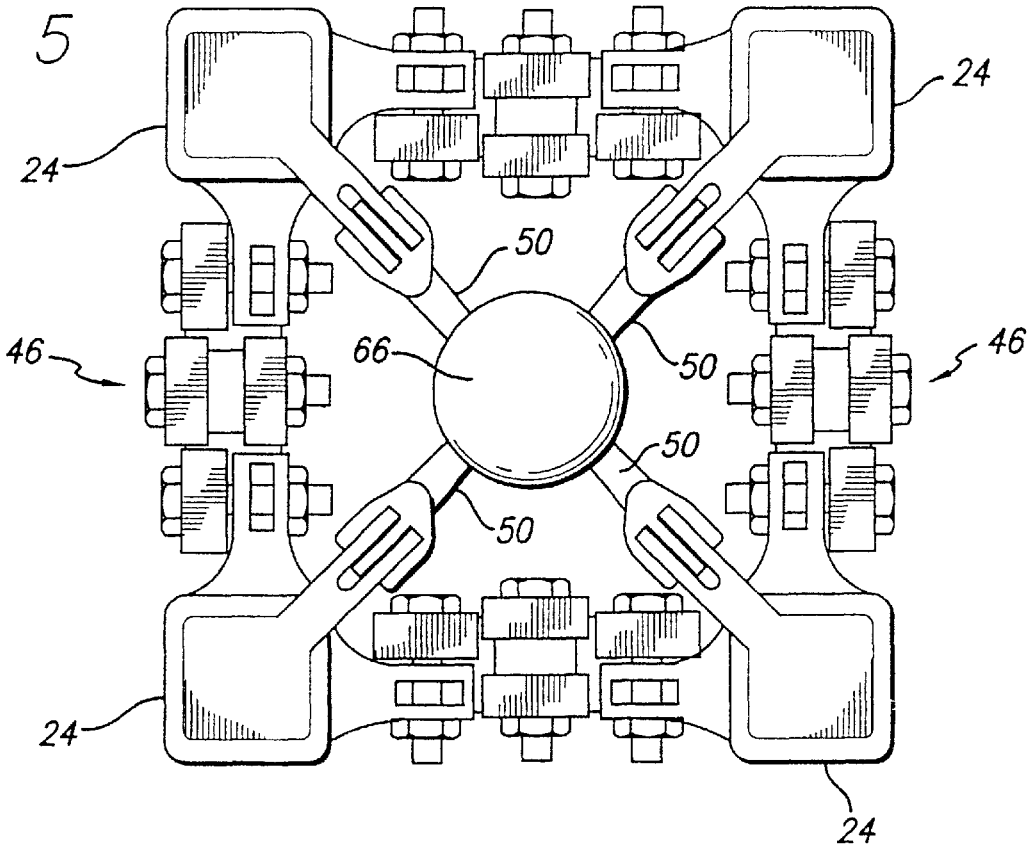
FIG. 5 is a top plan view of the quickly erectable canopy shelter of FIG. 1 in a folded configuration.

As is illustrated in the drawings, in a first presently preferred embodiment, the invention provides for a quickly erectable canopy shelter 20 having a plurality of legs 22, each having an upper end 24 and a lower end 26, as shown in FIG. 3. The collapsible shelter preferably has four legs, but can also have three, five, or more legs. Each leg also preferably has an upper section 28 and a telescoping lower section (not shown), with a slider member 32 slidably mounted to the upper section of each of the legs. An extendible perimeter assembly 34 of link members connects adjacent legs together. In a presently preferred embodiment, the extendible perimeter assembly of link members is formed by pairs of link members 36 pivotally connected together, with the pairs of link members including a first link member 38 and second link member 40. The first link member has an outer end 42 pivotally connected to the upper end of a leg, and the second link member has an outer end 44 pivotally connected to a slider member of a leg. The pairs of link members are preferably connected together in a scissors configuration so as to be extendable from a first collapsed position extending horizontally between adjacent pairs of legs to a second extended position extending horizontally between the adjacent pairs of legs. In a presently preferred aspect, the pairs of link members are connected together at their inner ends 46.

Figure 1:
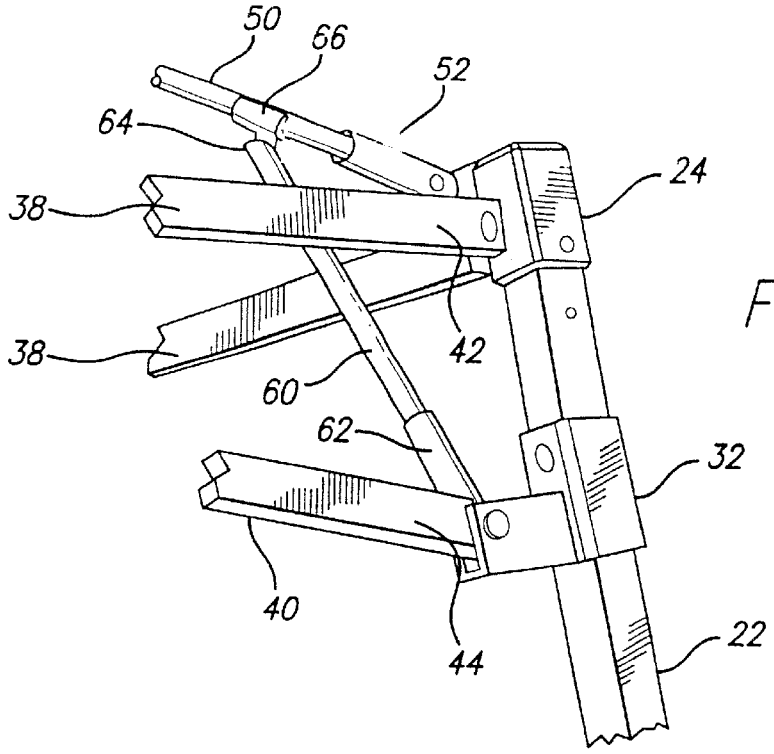
FIG. 1 is a perspective view of an upper corner portion of a first embodiment of the quickly erectable canopy shelter of the invention.
Figure 2:
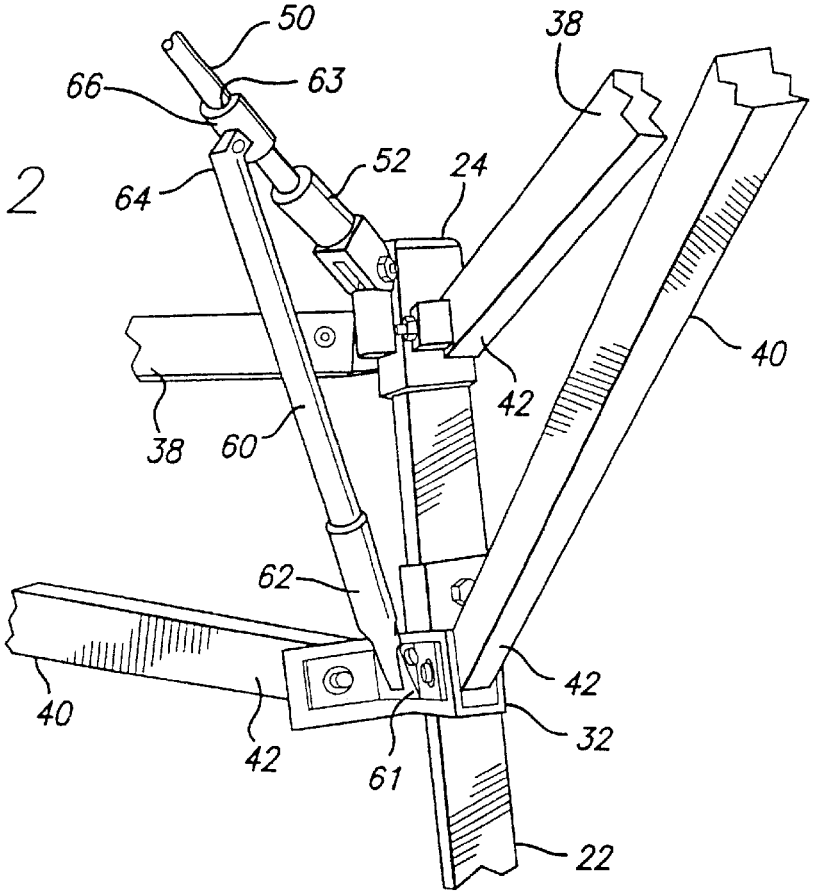
FIG. 2 is another perspective view of the upper corner portion of the quickly erectable canopy shelter of FIG. 1.
Figure 6:
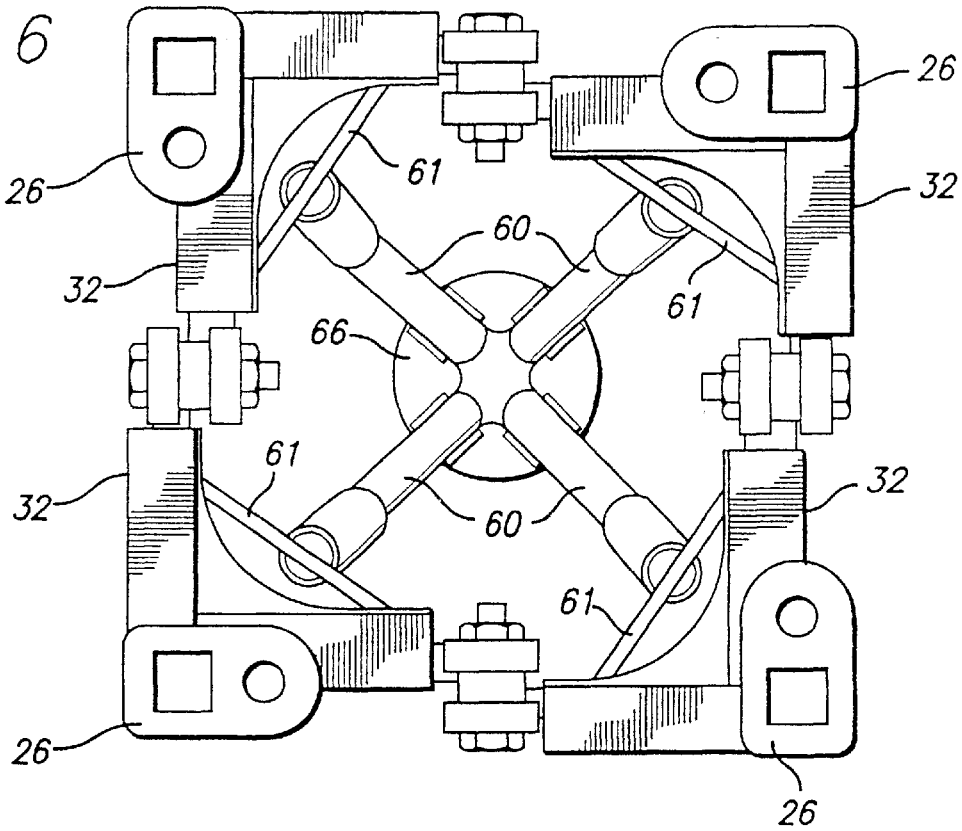
FIG. 6 is a bottom plan view of the quickly erectable canopy shelter of FIG. 1.

A roof structure is provided by a canopy assembly 48 that is supported by the legs. The canopy assembly preferably comprises a plurality of pole members 50 having their outer ends 52 mounted to the legs, as shown in FIGS. 1 and 2, to extend across the shelter and movable between a lowered position and a raised, upwardly extending position. As is shown in FIG. 3, each of the pole members currently preferably comprises a plurality of pole sections 54 pivotally joined together at hinges or joints 56 permitting inward, downward folding of the pole members to a folded configuration, and limiting upward unfolding of the pole members to a fully extended configuration. The outer ends of the pole members are preferably pivotally mounted to the upper ends of the legs, and a plurality of support strut members 60 are provided, as can best be seen in FIGS. 1 and 2, with the outer ends 62 of the support strut members pivotally mounted to the legs below the pole members, and preferably each support strut member is pivotally mounted, such as by welding, to a cross-brace 61 of a slider member, as shown in FIGS. 2 and 6. The inner ends 64 of the support strut members include an upwardly facing support bracket 66 adapted to be positioned against one of the plurality of pole members to receive and support the pole members in a raised, upwardly extending position. The pole members may also have a tab or ridge 63 as shown in FIG. 2 extending at a predetermined location from the surface of the pole members so as to provide a brace against which the support brackets may be lodged to allow the support strut members to positively lock the pole members in an upwardly arched configuration until the support struts are rotated downwardly to release the pole members to be foldable downward. Referring to FIGS. 3 to 6, the inner ends 64 of the pole members are pivotally connected together by a central hub 66. A canopy cover (not shown) may be provided over the roof structure of the shelter to provide a gabled roof surface, to shed precipitation and debris.

In a second preferred embodiment, the present invention provides for a quickly erectable canopy shelter 70 having a plurality of legs 72, each having an upper end 74 and a lower end 76. The legs are preferably formed of an upper section 78 and a lower telescoping sections (not shown), with a slider member 82 slidably mounted to the upper section of each of the legs. An extendible perimeter assembly 84 of link members connects the legs together and forms a plurality of sides of the shelter. The extendible perimeter assembly of link members is preferably formed by pairs of link members 86 pivotally connected together, and formed of a first link member 88 and a second link member 90. The first link member has an outer end 92 pivotally connected to the upper end of a leg, and the second link member has an outer end 94 pivotally connected to a slider member mounted to a leg. The inner ends 95 of the pairs of link members between adjacent legs are preferably connected together. The pairs of link members of the extendible perimeter assembly of link members are preferably connected in a scissors configuration so as to be extendable from a first collapsed position extending horizontally between pairs of legs to a second extended position extending horizontally between the pairs of legs.

Figure 9:
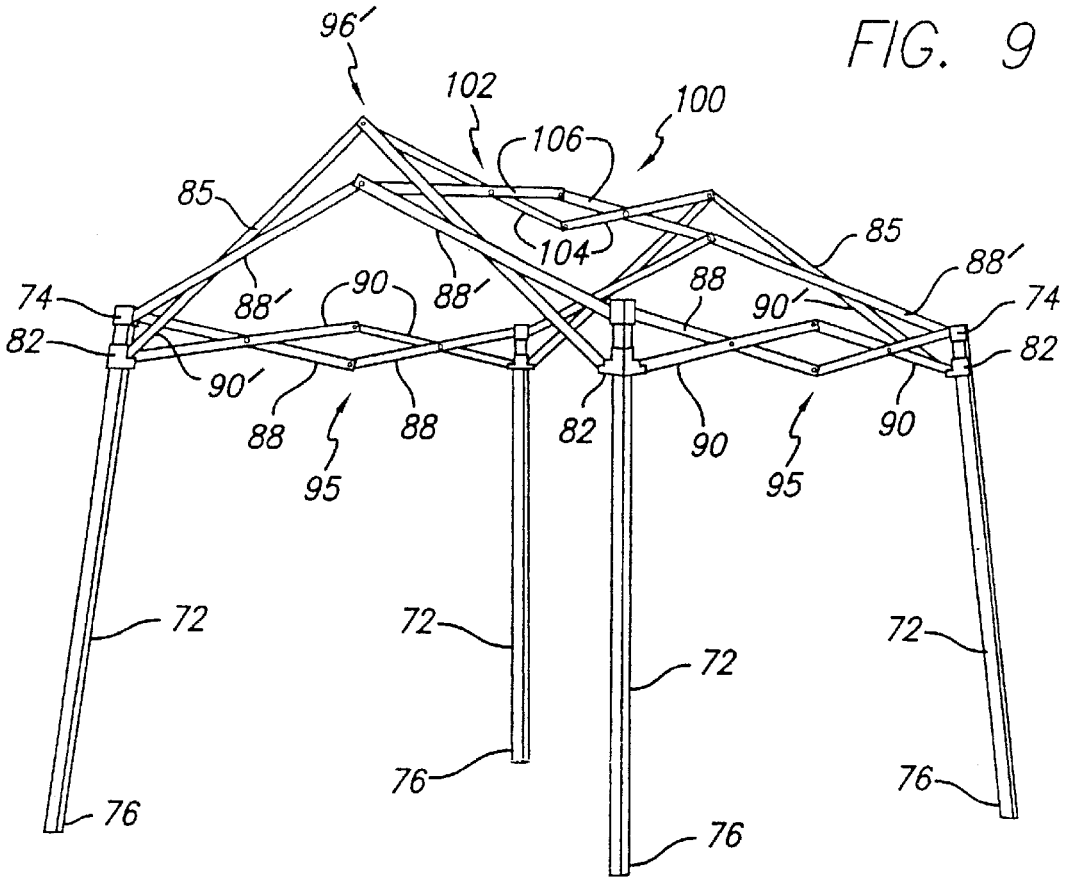
FIG. 9 is a perspective view of the quickly erectable canopy shelter of FIG. 7 in a fully extended configuration.
Figure 10:
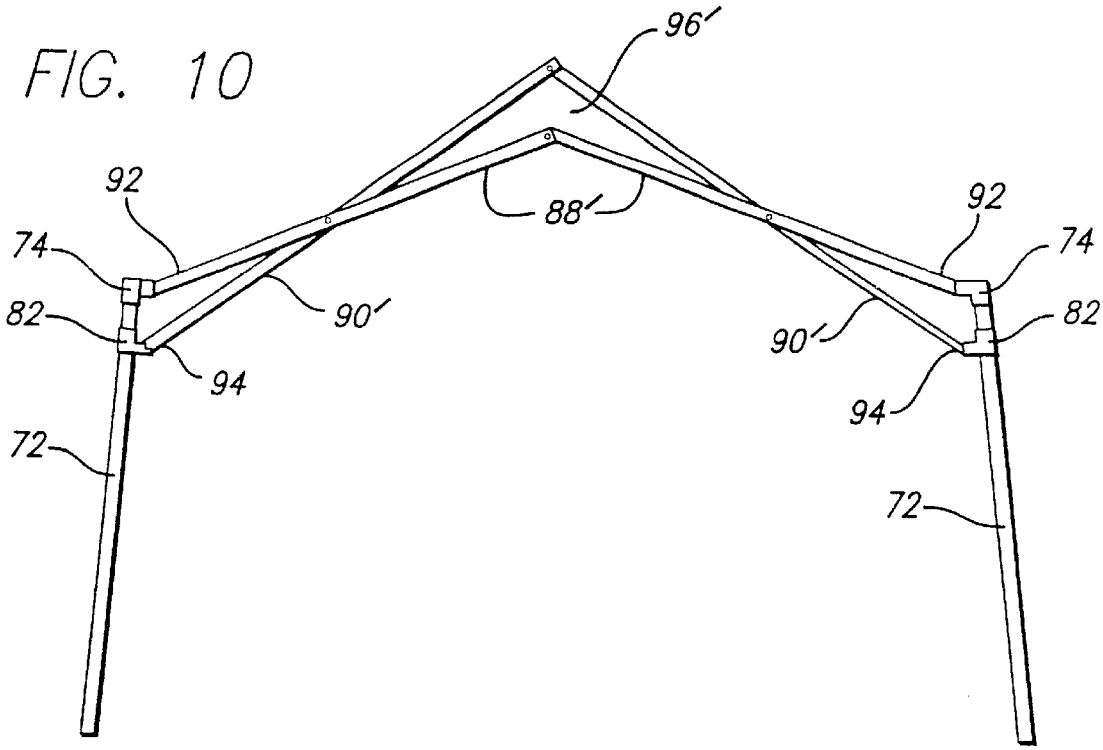
FIG. 10 is a front or rear view of the quickly erectable canopy shelter of FIG. 7 in a fully extended configuration.
Figure 11:
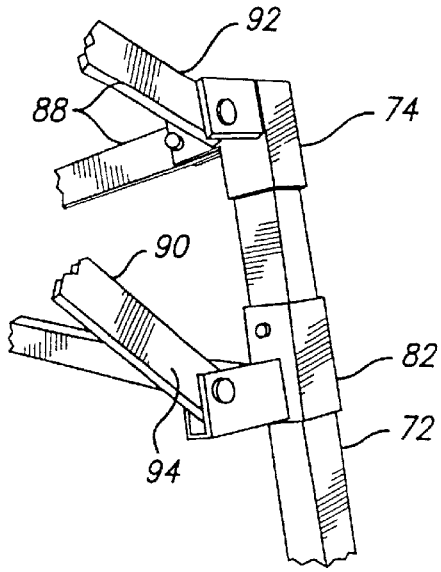
FIG. 11 is a perspective view of an upper corner portion of the quickly erectable canopy shelter of FIG. 7.
Figure 12:
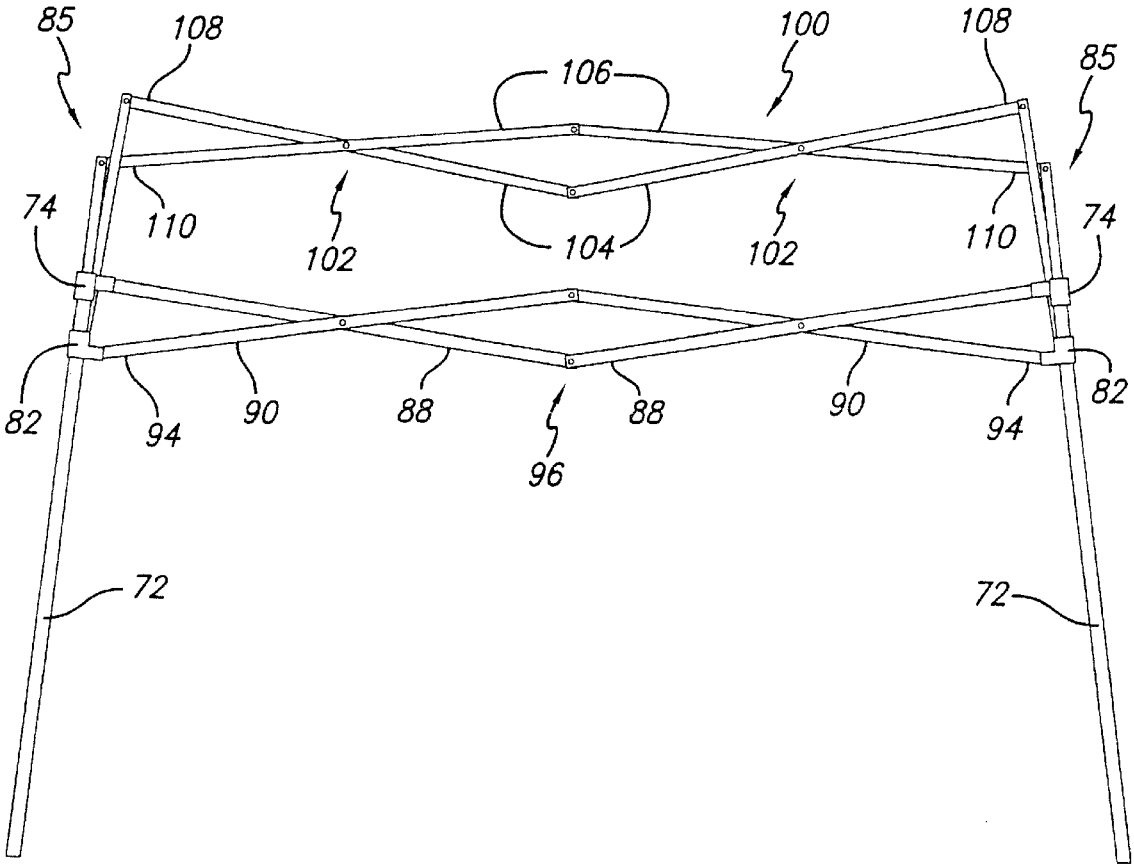
FIG. 12 is a side elevational view of the quickly erectable canopy shelter of FIG. 7 in a fully extended configuration.

As is illustrated in FIGS. 9, 10 and 12, at least one of the sides is raised, being formed by a pair of first and second link members 88', 90' dimensioned so as to extend above the upper ends of the legs when the shelter is in an extended configuration. In one presently preferred embodiment, as illustrated in FIGS. 7, 9 and 10, the inner ends 96' of the first link members 88' are connected together, and the inner ends 98' of the second link members 90' are connected together, and the second link members 90' are longer than the first link members 88' on each raised side, so that when the canopy shelter structure is fully extended, both the connected first link members 88' and the connected second link members 90' arch upwardly, with their inner ends 96' rising above the upper ends of the legs, as is best seen in FIG. 10. As is illustrated in FIGS. 7, 9, 10 and 12, in a presently preferred embodiment, two opposing sides of the shelter are raised above the upper ends of the legs so as to form a gabled configuration of the shelter when the shelter is extended. In addition, opposing sides 85 are connected together by central assembly of link members 100, preferably formed by central pairs of link members 102 pivotally connected together. The central pairs of link members include a first link member 104 and second link member 106, with the first and second link members having outer ends 108, 110 pivotally connected to the opposing sides. In a presently preferred implementation, the first link of a central pair of link members has an outer end 108 connected to the inner end of the second link of the perimeter pair of link members on one of the opposing sides, and the second link has an outer end 110 connected to the inner end of the first link of the second perimeter truss pair, with the first and second links of the central pairs of link members being pivotally connected together in a scissors configuration so as to be extendable horizontally from a first collapsed position to a second extended position. A canopy cover (not shown) may be provided over the roof structure of the shelter to provide a gabled roof surface, to shed precipitation and debris.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. In a quickly erectable canopy shelter, the shelter including a plurality of legs having upper and lower ends, and a slider member slidably mounted to each of said legs;

and an extendible perimeter assembly of link members connecting adjacent one of said legs together and forming a plurality of sides of said shelter, said extendible perimeter assembly of link members being formed by a plurality of pairs of link members being pivotally connected together in a scissors configuration so as to be extendable from a first collapsed position extending horizontally between pairs of legs to a second extended position extending horizontally between said pairs of legs, said pairs of link members between adjacent pairs of legs being connected together at their inner ends, the improvement comprising:

at least one of said sides of said shelter is raised when said shelter is fully extended, being formed by an assembly of first and second link members of said pairs of link members, said second link members having dimensions longer than dimensions of said first link members, such that the connected inner ends of said pairs of second link members extend above the connected inner ends of said pairs of first link members, and both said connected inner ends of said pairs of first and second link members extend above the upper ends of said pair of legs when the shelter is in an extended configuration.

2. The quickly erectable canopy shelter according to claim 1, wherein opposing sides of said shelter are raised so as to form a gabled configuration of said shelter when said shelter is extended.

3. The quickly erectable canopy shelter according to claim 1 further comprising a canopy cover disposed over said a plurality of legs and said extendible perimeter assembly of link members.

* * * * *